United States Patent [19]

Kinaga et al.

[11] Patent Number: 4,658,475

[45] Date of Patent: Apr. 21, 1987

[54] SIDE DOOR HINGE MECHANISM IN MOTOR VEHICLE

[75] Inventors: Eiichi Kinaga, Toyota; Daiichi Shiraishi, Seto, both of Japan

[73] Assignee: Toyota Jidosha Kabushiki Kaisha, Japan

[21] Appl. No.: 659,308

[22] Filed: Oct. 10, 1984

[30] Foreign Application Priority Data

Oct. 11, 1983 [JP] Japan ..... 58-157117[U]

[51] Int. Cl.[4] ..... E05D 3/10

[52] U.S. Cl. ..... 16/367; 16/369

[58] Field of Search ..... 296/146, 148; 49/246, 49/248; 16/82, 367-370

[56] References Cited

U.S. PATENT DOCUMENTS

| | | | |
|---|---|---|---|
| 2,956,836 | 10/1960 | James et al. | 16/370 |
| 3,074,755 | 1/1963 | Peras | 16/333 |
| 3,313,063 | 4/1967 | Patin | 16/369 |
| 3,369,833 | 2/1968 | Schaldenbrand | 16/82 |
| 3,594,853 | 7/1971 | Slattery | 16/367 |
| 3,758,990 | 9/1973 | Balanos | 16/370 X |

*Primary Examiner*—Donald R. Schran
*Assistant Examiner*—James L. Wolfe
*Attorney, Agent, or Firm*—Finnegan, Henderson, Farabow, Garrett & Dunner

[57] ABSTRACT

Hinge mechanism for a vehicle door comprising a vehicle frame having a mounting surface extending along the vehicle frame, another mounting surface extending along the vehicle door proximate the mounting surface on the vehicle frame, and support members extending between the mounting surfaces to support the door. The support members comprising support arms pivotally attached between brackets positioned on the mounting surfaces. The support arms are pivotally attached through rotary shafts, which are individually mounted at opposite ends of each of the support arms. The rotary shafts are aligned along independently inclined axes, which define a point of convergence beneath the hinge mechanism for the independent axes, so that the upper portion of the door is positioned away from the vehicle frame when the door is opened.

7 Claims, 7 Drawing Figures

SIDE DOOR HINGE MECHANISM IN MOTOR VEHICLE

BACKGROUND OF THE INVENTION

1. Field of the Invention

This invention relates to improvements in side door hinge mechanism utilizing a quadric crank chain in a motor vehicle.

2. Description of Related Art

Typically, the side door in a motor vehicle, such as a passenger car is installed in a manner to be rotatable about a hinge affixed to a vehicle body for opening or closing. In order to allow an occupant of the motor vehicle to open or close the side door for getting in or out of the motor vehicle, a door opening angle corresponding to the total length of the side door is required. At this time, when a space at the side of the motor vehicle is small, there are many situations where it is difficult for the occupant to get in or out of the vehicle because the side door cannot be opened sufficiently.

To overcome this difficulty, as has been disclosed in many publications such for examples as U.S. Pat. Nos. 3,074,755 and 3,095,600 and Japanese Utility Model Laid Opens Nos. 55-101,263 and 57-46,014, there has been proposed a side door hinge mechanism utilizing a quadric crank chain mechanism.

Furthermore, as proposed in U.S. patent application Ser. Nos. 611,149, 611,216 and 611,339 as shown in FIG. 1, there may be proposed a side door hinge mechanism in a motor vehicle, wherein a quadric crank chain comprises: a rotary link 4 interconnecting a vehicle body 2 and a side door 3 between rotary members 2A and 3A; a rotary link 5 also interconnecting the vehicle body 2 and the side door 3 between rotary members 2B and 3B; a body portion extends between the two rotary members 2A and 2B on the vehicle body 2; and a door portion extends between the two rotary members 3A and 3B along the side of the side door 3.

In the drawing, designated at 6 is a front pillar, 7 a front wheel and 8 a movable fender capable of rocking with the rotary link 4.

In the side door hinge mechanism utilizing the above-described quadric crank chain, a required space at the side of the door can be reduced while sufficient space for feet of the occupant is maintained. As a consequence, even when the space at the side of the door is small, the occupant can open or close the side door 3 to get in or out of the vehicle.

However, shown in FIG. 2 for example, as the outer shapes for the vehicle body of passenger cars and the like produced in recent years reflects a styling in which a door glass 9 portion is considerably inclined and curved upwardly and inwardly in the widthwise direction of the vehicle body. Because of this, even if there is provided the aforesaid side door hinge mechanism utilizing the quadric crank chain, the top end portion of a door frame of the side door 3 or the top end portion of a door glass 9 interferes with an occupant 10 when the occupant gets in or out of the vehicle. As a result the occupant 10 must considerably bend his upper body, in order to get in or out of the vehicle.

SUMMARY OF THE INVENTION

It is therefore the primary object of the present invention to provide a side door hinge mechanism in a motor vehicle, wherein even with the side door, the door frame or the top end of the door glass of which is curved or inclined inwardly in the widthwise direction of the vehicle body, the upper body of the occupant does not interfere with the top portion of the door when the occupant gets in or out of the vehicle, so that the satisfactory easiness in getting or or out of the vehicle can be secured.

To this end, the present invention contemplates that, in a side door hinge mechanism in a motor vehicle, wherein a quadric crank chain comprises: a first rotary link interconnecting a vehicle body and a side door; a second rotary link also disposed between the vehicle body and the side door; a portion extending between the first and second rotary links on the vehicle body; and another portion extending between the first and second rotary links on the side door; the aforesaid four rotary center shafts are inclined relative to one another in such a manner that of center axes of the four rotary center shafts interesect one another at one point beneath the hinge mechanism.

To the above end, the present invention further contemplates that the first and the second rotary links consist of a plurality of rotary links having rotary centers on the extensions of the center axes and being similar in shape to each other.

To the above end, the present invention contemplates that one of the first and the second rotary links comprises an integral member elongate in the vertical direction and the other comprises a plurality of split rotary links similar in shape and having the rotary centers on extensions of said center axes.

To the above end, the present invention contemplates that rotary center shafts on the vehicle body's side of said first and second rotary links are supported by a bracket on the vehicle body's side, the bracket being elongated substantially in the vertical direction and being secured to the vehicle body, and the rotary center shafts on the side door's side are supported by a bracket on the door's side extending substantially in the vertical direction and secured to the side door.

To the above end, the present invention contemplates that a door check mechanism is assembled between one of said first and second rotary links and said bracket on the vehicle body's side.

To the above end, the present invention contemplates that said first and second rotary links are small and formed in a space between an end panel of said side door and a front pillar.

In this invention, when the side door is opened, the top end of the side door is continuously inclined outwardly in the widthwise direction of the vehicle body whereby the top portion of the door does not interfere with the upper body of the occupant when the occupant gets in or out of the vehicle thereby enhancing the ease in getting in or out of the vehicle by the occupant.

DETAILED DESCRIPTION OF THE PREFERRED EMBODIMENT

Description will be given of one embodiment of the present invention with reference to the drawings.

Figure 3:
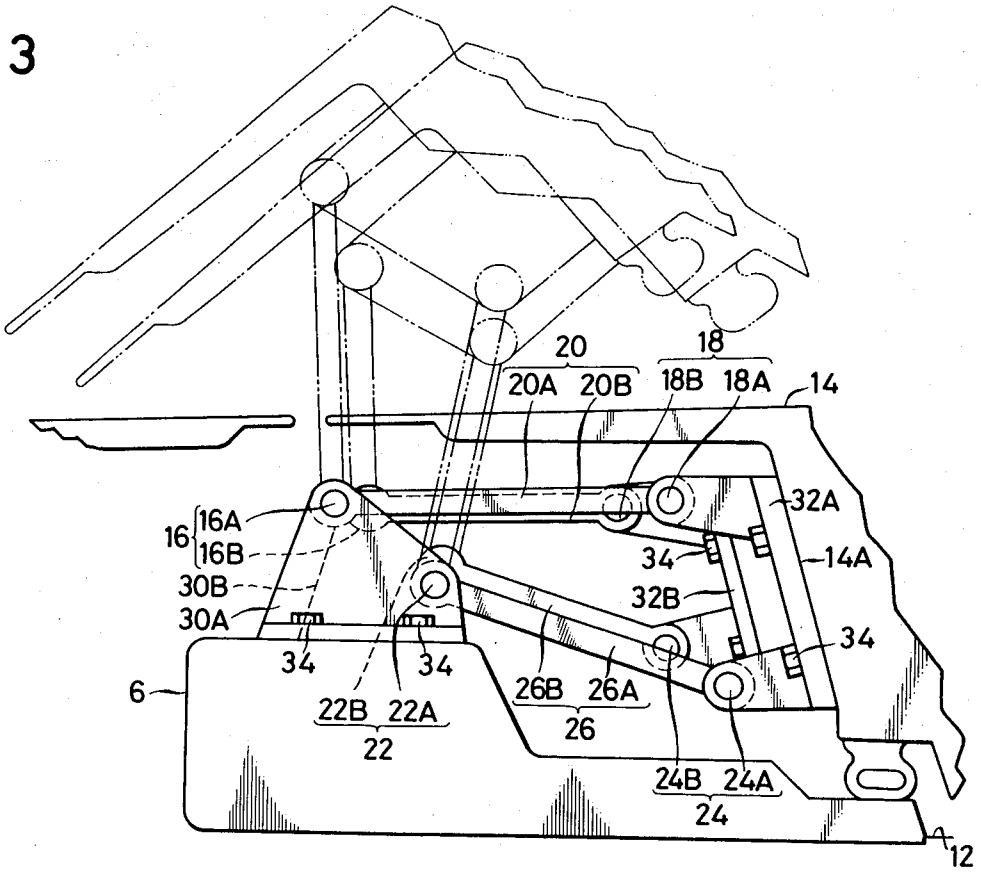
FIG. 3 is a schematic plan sectional view showing an embodiment of the side door hinge mechanism in a motor vehicle according to the present invention.
Figure 4:
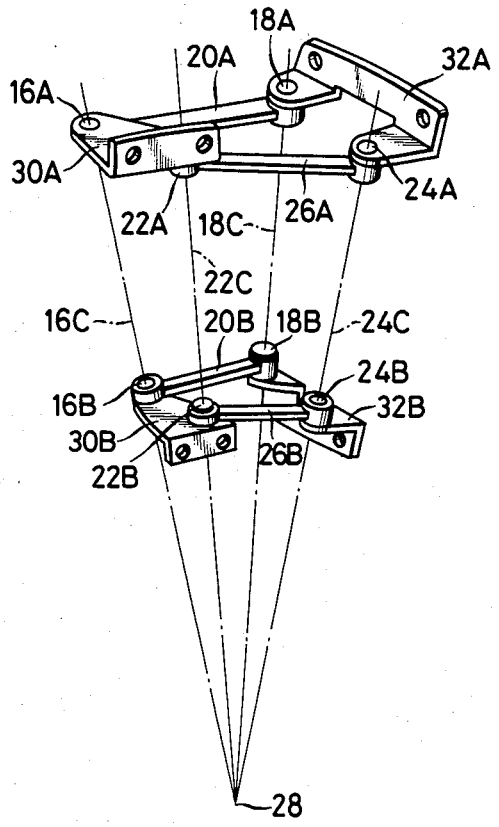
FIG. 4 is a perspective view showing the side door hinge mechanism in the above embodiment.
Figure 5:
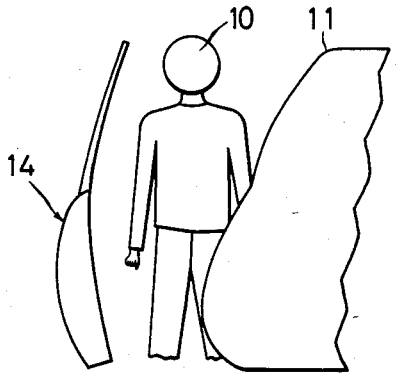
FIG. 5 is a schematic rear view showing the state where the side door is opened in the motor vehicle, to which the above embodiment is applied.

As shown in FIGS. 3 to 5, according to this embodiment, in a side door hinge mechanism in a motor vehicle, wherein a quadric crank chain comprises: a first rotary link means 20 interconnecting a vehicle body 12 and a side door 14 through rotary shafts 16 and 18 disposed on the vehicle body 12 and the side door 14; a second rotary link means 26 interconnecting the vehicle body 12 and the side door 14 through rotary center shafts 22 and 24; a body portion extends between the two points on the vehicle body 12; and door portion extends between the two points on the side door 14; the four rotary shafts 16, 18, 22 and 24 are inclined relative to one another in such a manner that downward extensions of center axes 16C, 18C, 22C and 24C of the four rotary center shafts are aligned to intersect one another at one point 28, as shown in FIG. 4.

The first rotary link means 20 is composed of upper and lower links 20A and 20B, which are similar in shape to each other and have their rotary axes extending along the center axes 16C and 18C, respectively. Similarly, the second rotary link 26 is composed of upper and lower links 26A and 26B, which are similar in shape to each other and have their rotary axes extending along the center axes 22C and 24C, respectively.

More specifically, the first rotary link means includes 20 the first upper link 20A and the first lower link 20B and the second rotary link means 26 includes the second upper link 26A and the second lower link 26B, the first and second links rotating in synchronism about the center axes 16C and 18C, and 22C and 24C, respectively.

Figure 1:
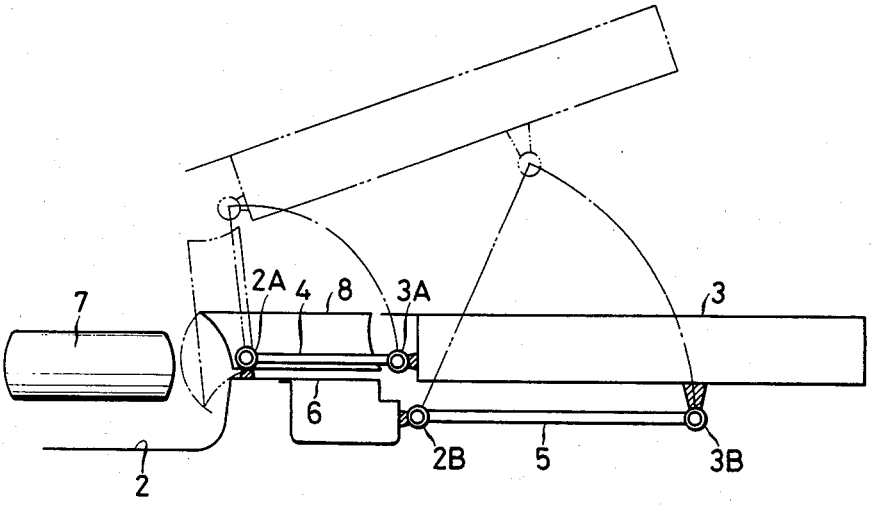
FIG. 1 PRIOR ART
FIG. 1 is a schematic plan sectional view showing the conventional side door hinge mechanism in a motor vehicle.
Figure 2:
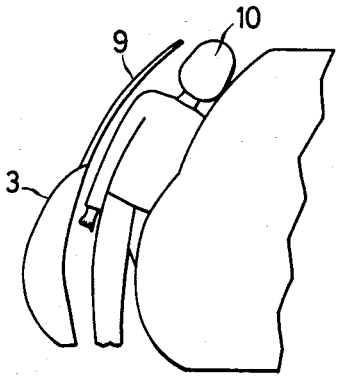
FIG. 2 PRIOR ART
FIG. 2 is schematic rear view showing the state where the side door is opened in the motor vehicle utilizing the aforesaid conventional side door hinge mechanism.

According to this embodiment the present side door hinge mechanism utilizing a quadric crank chain, differs from one shown in FIG. 1, particularly since it is a small-sized link mechanism extending between an end panel 14A of the side door 14 and the front pillar 6.

According to the present invention, the rotary shafts 16A and 22A on the side of the vehicle body 12 are rotatably mounted to an upper bracket 30A extending from the side of the vehicle body, and the rotary shafts 18A and 24A on the side of the side door 14 are also rotatably mounted to an upper bracket 32A on the side door.

In other words, the upper bracket 30A on the vehicle body's side and the upper bracket 32A on the door's side form a quadric crank chain in cooperation with the first upper link 20A and the second upper link 26A.

Similarly, the rotary shafts 16B and 22B of the first lower link 20B and the second lower link 26B on the vehicle body's side are rotatably mounted to a lower bracket 30B extending from the vehicle body, and the rotary shafts 18B and 24B of the first lower link 20B and the second lower link 26B on the door's side are also rotatably mounted to a lower bracket 32B extending the door side.

As a consequence, the lower bracket 30B on the vehicle body's side and the lower bracket 32B on the door's side also form a quadric crank chain in cooperation with the first lower link 20B and the second lower link 26B.

The upper bracket 30A and the lower bracket 30B on the vehicle body's side are tightly fastened to the outer surface of the front pillar 6 on the vehicle body's side through bolts 34.

Additionally, the upper bracket 32A and the lower bracket 32B on the door's side are tightly fastened to the end panel 14A through another set of bolts 34, similarly.

Description will be given of operation of the present invention.

The side door 14 is mounted to the vehicle body through the hinge mechanism utilizing the quadric crank chain as described above, so that when the side door 14 is opened, an opening necessary for the getting in or out of the vehicle by the occupant can be obtained and the side door 14 does not extend an excessive amount away from the vehicle body.

At this time, the rotary center shafts 16, 18, 22 and 24 as being the rotary centers in the quadric crank chain are inclined relative to one another in such a manner that the center axes 16C, 18C, 22C and 24C thereof intersect one another at one point 28 located beneath the quadric crank chain of the present invention, so that when the side door 14 is opened, the top end portion of the side door 14 is inclined further away from the vehicle body than the bottom end portion as shown in FIG. 5.

Further the relative angles of inclination of the rotary center shafts 16, 18, 22 and 24 are suitably selected, such that the bottom end of the side door 14 does not interfere with feet of the occupant 10 getting into or out of the vehicle. Therefore, the relative angles of inclination away from the vehicle body at the top end portion of the side door 14 are larger than those at the bottom end portion of the side door 14, so that the top end portion is further inclined not to prevent interference with the upper body of the occupant.

As a consequence, the occupant 10 can get in or out of a motor vehicle 11 without bending one's upper body toward the vehicle.

Particularly in this embodiment, the side door hinge mechanism utilizing the quadric crank chain is small and is interposed between the end panel 14A of the side door 14 and the front pillar. As such, this embodiment is advantageous in that the link mechanism can be made compact in size so that the rotary links are not exposed to the compartment as compared with the link mechanism utilizing long rotary links shown in FIG. 1 for example.

The above-described compact arrangement has been made possible because each of the two rotary links is composed of the pair of upper and lower links to support a load of the side door 14 and control the rotating paths of the two rotary links.

The previously described embodiment of the present invention is applied to the side door hinge mechanism is small enabling the hinge mechanism to be connected between the end panel 14A of the side door 14 and the center pillar 6. The present invention is not limited to this configuration. In the regard the present invention is applicable to the side door hinge mechanism utilizing the long rotary links shown in FIG. 1 for example.

Furthermore, in the above embodiment, a pair of upper and a pair of lower quadric crank chains having rotary shafts on the four center axes 16C, 18C, 22C and 24C are utilized, however, a plurality of quadric crank chains even more than three or only one quadric crank chain may be utilized.

If one quadric crank chain is used, the rotary center shafts may be formed to extend along a substantial length of the center axes 16C, 18C, 22C and 24C.

Figure 6:
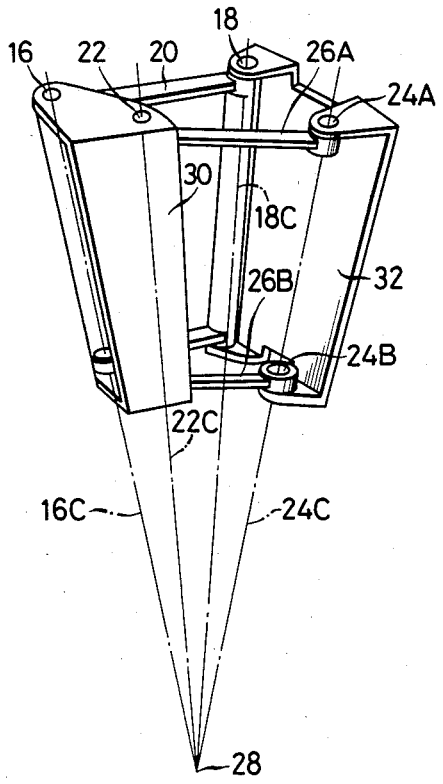
FIGS. 6 and 7 are perspective views showing the side door hinge mechanism in a second and a third embodiments of the present invention.

For example, as shown in FIG. 6, the quadric crank chain includes a single bracket 30 on the vehicle body's side and a single bracket 32 on the door's side, both of which are formed along a substantial length of the center axes 16C, 18C, 22C and 24C. This embodiment also includes a single rotary link 20, a second upper link 26A and a second lower link 26B.

In this case, the first rotary link 20 primarily supports the load of the side door 14 and is elongated integrally in the vertical direction. The second rotary link performing the control arm function controls the rotating path of the side door 14 and is composed of a thin second upper link 26A and second lower link 26B.

According to this embodiment, the bracket 30 on the vehicle body's side, the bracket 32 on the door's side and the first rotary link 20, which support the primary load of the door are each formed into a unitary structure extending in the vertical direction. Further the second rotary link performing the control arm function is divided into the thin second upper link 26A and the thin second lower link 26B, so that the total weight of the hinge mechanism can be reduced.

Furthermore, the bracket 30 on the vehicle body's side and the bracket 32 on the door's side are each formed into a unitary from structure extending substantially in the vertical direction, so that this embodiment is advantageous in that the brackets 30 and 32 can be easily mounted to the vehicle body 12 and the side door 14, respectively.

Figure 7:
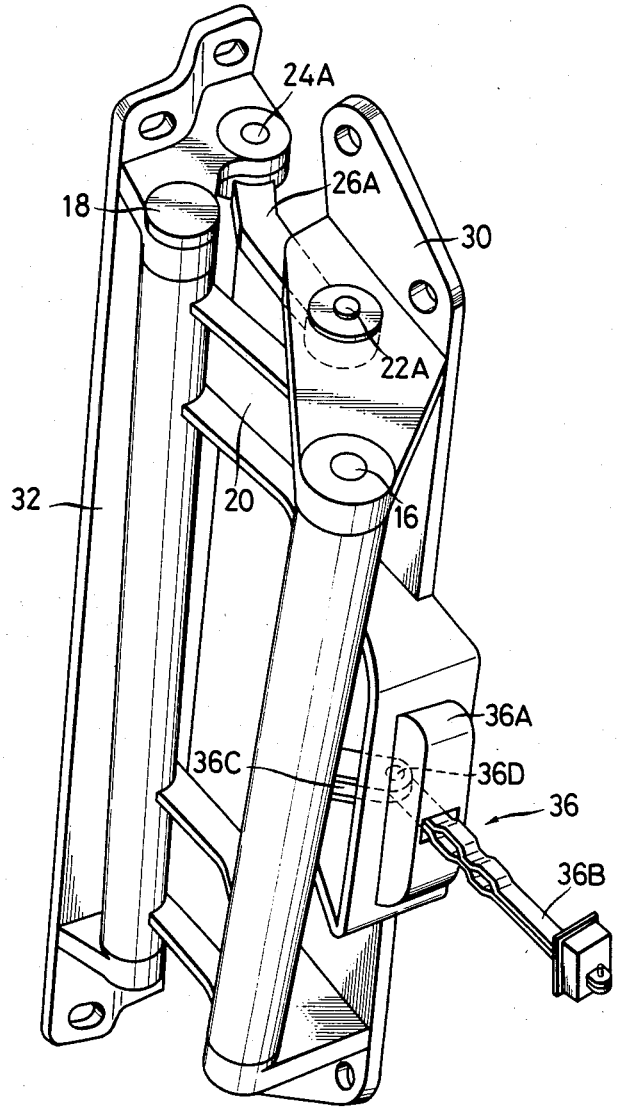

Description will be given of the third embodiment of the present invention as shown in FIG. 7.

In this third embodiment, the top and the bottom sides of the first rotary link 20 have a substantially square frame shape are each formed into a U-shape in cross section, and a door check mechanism 36 is assembled between this rotary link 20 and the bracket 30 on the vehicle body's side.

More specifically, this door check mechanism 36 is of such an arrangement that a door check body 36A is mounted to the bracket 30 on the vehicle body's side. A bracket 36C is secured to the rotary link 20 to transmit a relative rotary displacement of the side door 14 to a door check arm 36B, which extends through and is in sliding contact with this door check body 36A and forms a door checking force. The forward end of the door check arm 36B is pivotally engaged with the forward end of this bracket 36C through a pin 36D.

In this third embodiment, the first rotary link 20 can be further increased in rigidity, the number of parts, weight and number of man-hour for assembling can be reduced by assembling the door check mechanism 36 into a unitary structure. In addition, the appearance is improved by disposing the door check mechanism 36 in a concealed position that is, where the door check mechanism cannot be observed from the outside.

What is claimed is:

1. A hinge mechanism for a vehicle door comprising:

a vehicle frame including first means extending along said vehicle frame for mounting the door to said vehicle frame, the door also having second means extending along the door proximate said first mounting means for mounting the door to said vehicle frame, the door having an upper portion and a lower portion; and support means extending between said first and second mounting mens for supporting the door, said support means including:

frame bracket means affixed to said first mounting means, said frame bracket means having an upper frame bracket means and a lower frame bracket means;

door bracket means secured to said second mounting means, said door bracket means having an upper door bracket means and a lower door bracket means;

support arms extending between said frame bracket means and said door bracket means wherein said support arms extending between said upper frame bracket means and said upper door bracket means are longer than said support arms extending between said lower frame bracket means and said lower door bracket means; and pivot means at opposite ends of said support arms for pivotally attaching said support arms to said frame bracket means and to said door bracket means, wherein said pivot means includes rotary shafts individually mounted at opposite ends of each of said support arms, each of said rotary shafts aligned along independently inclined axes, and wherein said axes define a point of convergence beneath the hinge mechanism, enabling said upper portion of the vehicle door to be positioned away from said vehicle frame when the door is opened.

2. The hinge mechanism defined in claim 1, wherein said second mounting means is formed on an end surface extending between the exterior and the interior of the door.

3. A hinge mechanism for a vehicle door comprising:

a vehicle frame including first means extending along said vehicle frame for mounting the door to said vehicle frame, the door also having second means extending along the door proximate said first mounting means for mounting the door to said vehicle frame, the door having an upper portion and a lower portion; and support means extending between said first and second mounting means for supporting the door, said support means including frame bracket means affixed to said first mounting means, door bracket means secured to said second mounting means, support arms extending between said frame bracket means and said door bracket means, and pivot means at opposite ends of said support arms for pivotally attaching said support arms to said frame bracket means and to said door bracket means, wherein said pivot means includes rotary shafts individually mounted at opposite ends of each of said support arms, each of said rotary shafts aligned along independently inclined axes, and wherein said axes define a point of convergence beneath the hinge mechanism, enabling said upper portion of the vehicle door to be positioned away from said vehicle frame when the door is opened; and said support arms include a primary support arm and secondary support arms, said frame bracket means and said door bracket means measuring a predetermined vertical length, wherein said primary support arm extends substantially along said predetermined vertical length between said frame bracket means and said door bracket means, and wherein said secondary support arms have a small vertical cross section relative to said primary support arm, allowing said secondary support arms to pivot with the primary support arm and guide the door when the door is opened and closed.

4. The hinge mechanism defined in claim 3, wherein said second mounting means is formed on an end surface extending between the exterior and the interior of the door.

5. The hinge mechanism defined in claim 3, also including door check means extending between one of said support arms and said frame bracket means for restricting the pivotal movement of the door when the door is opened.

6. The hinge mechanism defined in claim 5, said door checking means including a bracket arm mounted on said one of said support arms, a door check arm pivotally mounted on said bracket arm, and engagement means mounted on said frame bracket means for releasably engaging said door check arm.

7. The hinge mechanism defined in claim 6, wherein said door check arm contains an irregular surface, and wherein said engagement means includes an aperture for receiving said door check arm and for slidably engaging said irregular surface when the door is opened and closed.

* * * * *